United States Patent [19]

Bodewein et al.

[11] Patent Number: 4,770,406

[45] Date of Patent: Sep. 13, 1988

[54] DEVICE FOR STACKING SHEETS

[75] Inventors: Jakob Bodewein, Monchen-Gladbach; Dieter Osburg, Neuss, both of Fed. Rep. of Germany

[73] Assignee: Jagenberg Aktiengesellschaft, Dusseldorf, Fed. Rep. of Germany

[21] Appl. No.: 919,291

[22] Filed: Oct. 15, 1986

[30] Foreign Application Priority Data

Oct. 16, 1985 [DE] Fed. Rep. of Germany ..... 3536859

[51] Int. Cl.[4] ..... B65H 9/04

[52] U.S. Cl. ..... 271/223

[58] Field of Search ..... 271/223, 224, 171

[56] References Cited

U.S. PATENT DOCUMENTS

| | | | |
|---|---|---|---|
| 1,457,094 | 5/1923 | Thompson | 271/171 X |
| 3,617,052 | 11/1971 | Buccicone | 271/224 X |
| 4,097,042 | 6/1978 | Rozga | 271/171 X |

FOREIGN PATENT DOCUMENTS

| | | | |
|---|---|---|---|
| 3114414 | 10/1982 | Fed. Rep. of Germany . | |
| 2061886 | 5/1981 | United Kingdom | 271/223 |

*Primary Examiner*—Richard A. Schacher
*Attorney, Agent, or Firm*—Sprung Horn Kramer & Woods

[57] ABSTRACT

The invention relates to a sheet stacking device on paper cross-cutting machines, consisting of a sheet supply and stacker device. A stacking device of this type comprises elements which retard the paper sheets supplied from a supply speed to zero and thus guide the sheets so that after being laid down they form a stack having a straight edge. The auxiliary elements required for the direct formation of the stack form the sheet stop board (8) and lateral guide plates (12, 13). In the case of a change of format, which generally necessitates a displacement of the sheet stop board (8) in the direction in which the sheets are supplied and of the lateral guide plates (12, 13) at right angles to the direction in which the sheets are supplied, in the case of an automatic format adjustment for the sheet stacking device, an exchange of the format-dependent lateral guide plates (12, 13) is no longer required. Therefore it was necessary to construct the lateral guide plates so that they are no longer exchanged when the format is changed, but that their effective length can be adapted to the respective longitudinal format of the sheets. This takes place due to the fact that each lateral guide plate (12, 13) is divided into at least two parts, so that with a large format, both parts form a long lateral guide plate (12, 13) and with a short format, a part (13) is raised by a drive (19), so that the sheet stop board (8) may pass under the raised lateral guide plate (13) close up to the lateral guide plate (12) which has remained in the working position.

2 Claims, 2 Drawing Sheets

DEVICE FOR STACKING SHEETS

Figure 1:
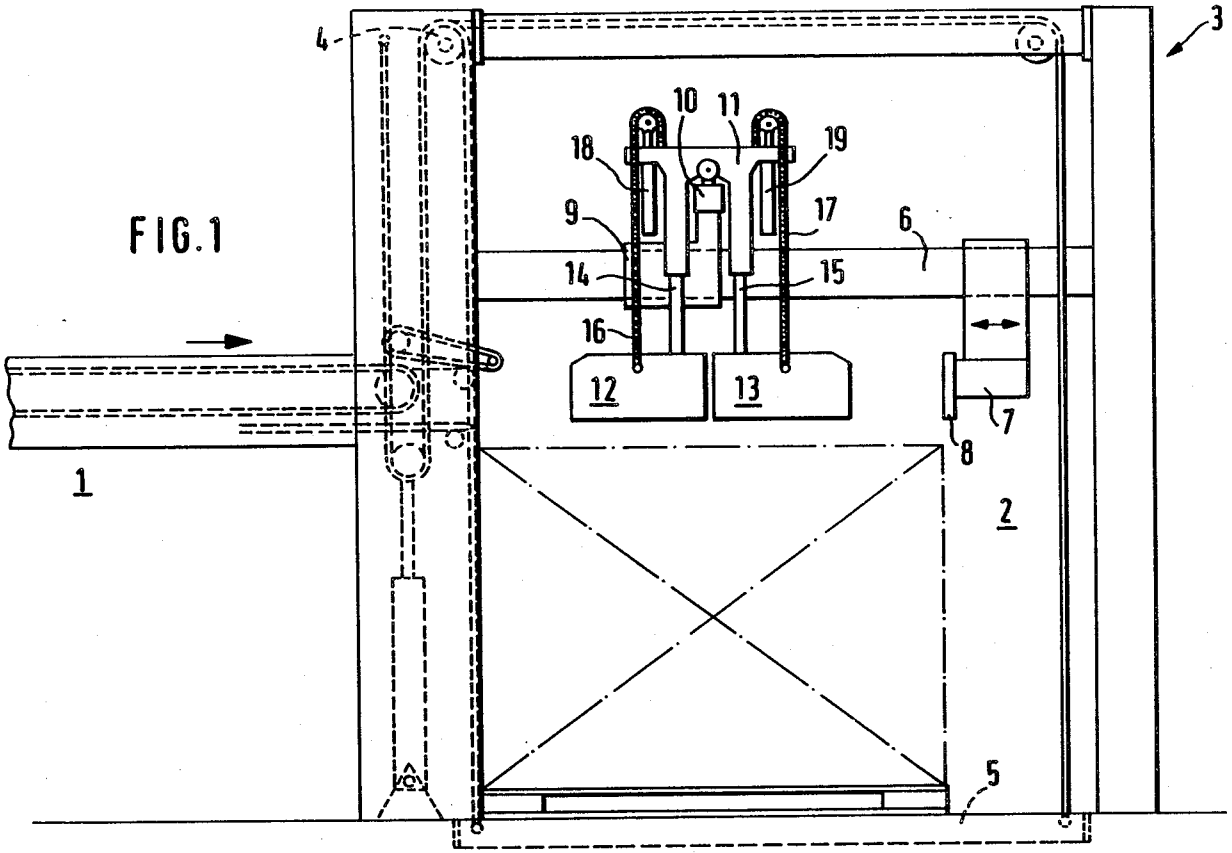

The invention relates to a sheet stacking device on paper cross-cutting machines, consisting of a sheet feed device and stacker.

Devices of this type are required to be able to be adjusted to different format lengths. Hitherto this adjustment necessitated quite complicated and time-consuming manipulations, because the sheet stacking device consisting of several stacking device members, such as separating shoes, lateral guide plates, sheet stop boards etc., must be adjusted individually. In this case, the members, which guide the stack in the lateral dimension, as well as the members which guide the stack in its longitudinal dimension are adjusted, since when changing the format, the format width and the format length are altered. There are two types of lateral guide plate and in particular those which are arranged on the outside of a stack and those which with a material web divided longitudinally once or several times are located within the stack respectively in the separation gap, in order to separate the individual formats from each other. Whereas the outer lateral guide plates are set in oscillation by vibrators, in order to achieve a lateral vibrating effect, the lateral guide plates located within the stack have no additional means and are stationary during operation. According to experience, these outer and inner lateral guide plates must have such a longitudinal dimension that they guide each format in such a large area, which is greater than half the length of the respective format. Now since a format length scale of approximately 600 mm to 2000 mm is used on a modern paper cross-cutter, as a rule one cannot manage with a single format size for the lateral guide plates. For the aforementioned format scale, the user is compelled to store several lateral guide plates of different length, in order to be able to install different lateral guide plates according to the format length. Moreover it must be assumed that up to 8 lateral guide plates are used simultaneously one beside the other. The exchange of these lateral guide plates is therefore also not least time-consuming and laborious, because in the case of large formats, the lateral guide plates have a high weight. Since in the course of rationalization, the economy of a processing machine also has to be increased, i.e. format changing time has to be saved, in the case of automation one proceeds on the basis that when changing format, not only a displacement of the lateral guide plates, but also the alteration of the effective length of the lateral guide plates must be automated. The manual exchange of these lateral guide plates which was hitherto conventional in addition to the automatic format adjustment, is accordingly not suitable for shortening the stoppage time for a complete change of format. It is the object of the invention in a sheet stacking device as described hereinabove, when changing the format to adapt the lateral guide plates bringing about the guidance of the sheets, as regards their reflective length, to the respective format length.

This object is realized in accordance with the present invention which relates to a machine for cutting a continuous web of paper into sheets of predetermined sizes and stacking such sheets, comprising means for cutting said web, means for transporting the sheets cut from said web and means for stacking the cut sheets, the stacking means including at least two lateral guide plates and means for moving said lateral guide plates.

The invention provides means for moving said lateral guide plates longitudinally in the feed direction of the sheets so as to adjust the disposition of said guide plates for operation on different size sheets.

Advantageously, each lateral guide plate comprises at least two guiding parts, said moving means including means for moving one of said guiding parts vertically relative to the balance of each lateral guide plate.

The stacking means advantageously includes a support slide movable in the direction of movement of the sheets, a cross-member extending transversely of the support slide, a carriage on the cross-member, at least one guide rod extending from said carriage to each lateral guide plate, and means for adjusting the effective length of said guide rods.

The lateral guide plates which can be shortened or lengthened by means of their own drive have the advantage that during the time when they are moved laterally to a new width format, they can simultaneously be adapted to the new longitudinal format. This means that additional time for the adaptation of the lateral guide plate to the new format length is not required. In addition, the machine operators are relieved of this task and can therefore take over important control functions for the entire plant during the change of format.

Figure 2:
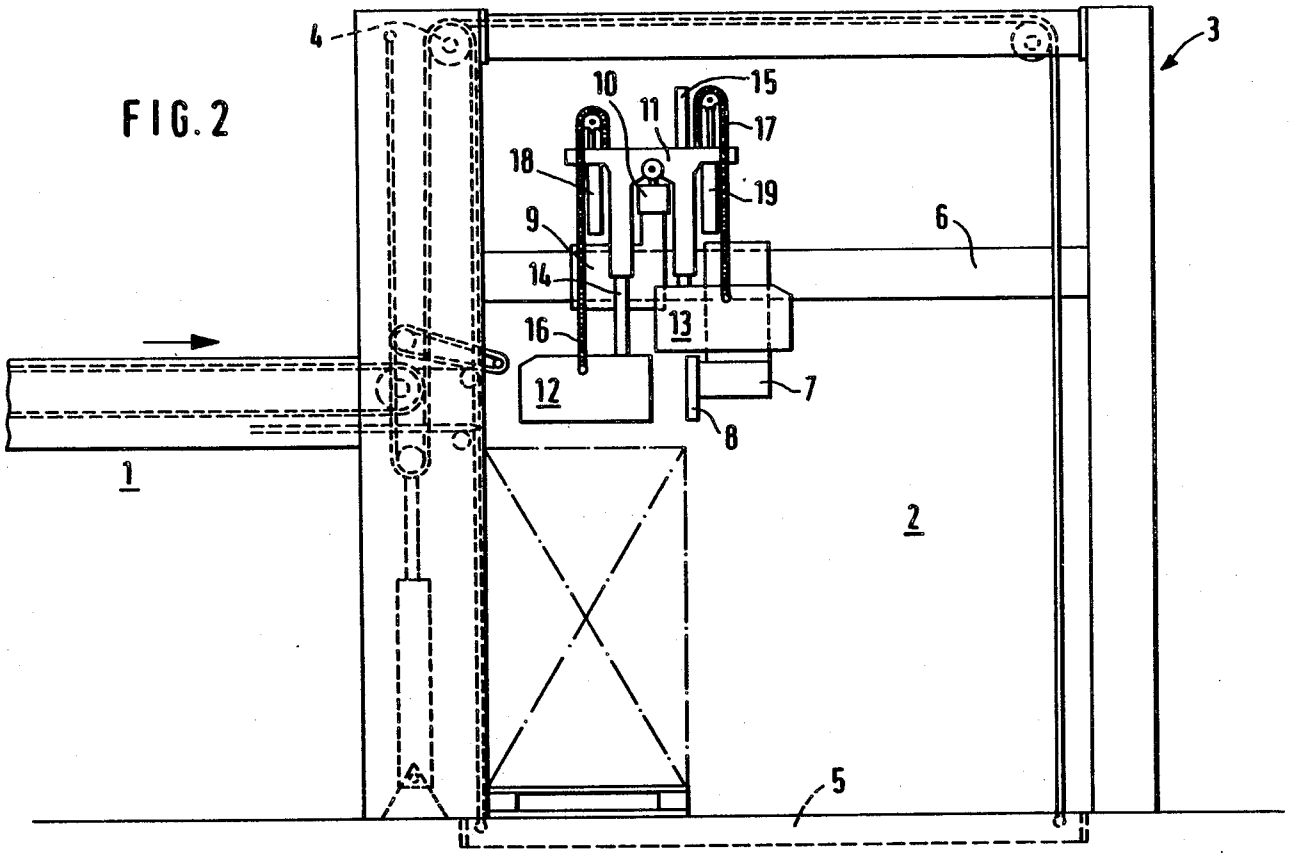

The invention will be further described with reference to the accompanying drawings, wherein:

FIG. 1 shows a sheet stacking device in side view with a lateral guide plate for a large format and FIG. 2 shows the same device with a lateral guide plate for a small format.

In FIG. 1, the sheet stacking device consists of a sheet transfer member 1 and a stacker 2. The stacker 2 itself consists of a frame 3, on which a support device 4 for the stack table 5 is located. Furthermore this frame 3 comprises guide rails 6 arranged on both sides in the direction in which the sheets are supplied, on which guide rails a cross member 7 is able to move in the direction in which the sheets are supplied. The cross member 7 supports a sheet stop board 8, which is moved by the cross member 7 according to the format length. At the same time a carriage 9 is respectively provided on both guide rails 6, respectively able to move in the direction in which the sheets are supplied, which carriages are connected to each other by a cross member 10. Located on this cross member 10 are carriages 11 able to move at right angles to the direction in which the sheets are supplied, on which carriages lateral guide plates 12 and 13 are supported by means of guide rods 14, 15. These guide rods 14, 15 are mounted to move vertically in the carriage 11. In addition, a support member, for example a chain 16, 17 is respectively attached to the lateral guide plates 12, 13, which chains can be respectively driven by way of a separate drive 18, 19 independently of each other. Due to the separate drives, one is now in a position to bring two (FIG. 1) or only one lateral guide plate (FIG. 2) as in the case illustrated, selectively into the operative position. For the case where the material web is not divided lengthwise, that is to say that only the two outer and none of the six inner lateral guide plates are required, all the inner lateral guide plates 12, 13 must be raised by their drives 18, 19, in order that the inner lateral guide plates 12, 13 come out of engagement. The vertical adjustability of the individual lateral guide plates 12, 13 must be so great that the sheet stop board 8 can travel without hindrance below the raised lateral guide plate 13, as shown in FIG. 2.

For the division of the lateral guide plates 12, 13 it is conceivable that the lateral guide plates can be divided into three. For the drive of the vertical adjustment, guide rods with an integrated rack and pinion drive as well as a drive by means of a working cylinder are also possible.

It will be understood that the specification and examples are illustrative but not limitative of the present invention and that other embodiments within the spirit and scope of the invention will suggest themselves to those skilled in the art.

What is claimed:

1. In a machine for cutting a continuous web of paper into sheets of predetermined sizes and stacking such sheets, comprising means for transporting the sheets cut from said web and means for stacking the cut sheets, the stacking means including a lateral guide plate and means for moving said lateral guide plate parallel to and across the sheet feed direction and for raising said guide plate above the level of the stack, the improvement wherein said lateral guide plate comprises at least two guiding parts (12,13) and means (16, 17, 18, 19) for independently raising and lowering said guiding parts so as to adjust the disposition of said guide plates for operation on different size sheets.

2. A machine according to claim 1, wherein the two guiding parts (12, 13) are mounted on channeling rods (14, 15) on a yoke-like carrier (11) that is mounted across the sheet-feed direction on a crossarm (10) on a slide (9) that travels along the sheet-feed direction.

* * * * *